United States Patent [19]

Urban

[11] 4,306,427

[45] Dec. 22, 1981

[54] CHRYSOBERYL GEMSTONES

[75] Inventor: Stanley W. Urban, Sparta, N.J.

[73] Assignee: Allied Corporation, Morris Township, Morris County, N.J.

[21] Appl. No.: 84,706

[22] Filed: Oct. 15, 1979

[51] Int. Cl.[3] ..... A44C 17/00

[52] U.S. Cl. ..... 63/32

[58] Field of Search ..... 63/32; D11/90

[56] References Cited

U.S. PATENT DOCUMENTS

| | | | |
|---|---|---|---|
| D. 35,938 | 6/1902 | Schenck | 63/32 X |
| D. 36,142 | 11/1902 | Wood | 63/32 X |
| D. 59,297 | 10/1921 | Steel | D11/90 |
| 3,835,665 | 9/1974 | Kitchel | 63/32 |
| 4,118,949 | 10/1978 | Grossbard | 63/32 |

FOREIGN PATENT DOCUMENTS

| | | | |
|---|---|---|---|
| 2254321 | 5/1974 | Fed. Rep. of Germany | 63/32 |
| 772941 | 8/1934 | France | 63/32 |

OTHER PUBLICATIONS

Thompson, R. F., Article in Gems and Minerals, May, 1973, p. 39.

*Primary Examiner*—F. Barry Shay

*Attorney, Agent, or Firm*—James Riesenfeld; Gerhard H. Fuchs

[57] ABSTRACT

A chrysoberyl gemstone cut in a modified brilliant style is provided. The gemstone has seven rows of facets, including a girdle comprising rectangular facets. Each row contains eight, ten or twelve facets. The bottom row of facets is visible as a rosette pattern when the gemstone is viewed through the table.

9 Claims, 9 Drawing Figures

CHRYSOBERYL GEMSTONES

BACKGROUND OF THE INVENTION

1. Field of the Invention

This invention relates to chrysoberyl gemstones and, more particularly, to chrysoberyl gemstones cut in a modified brilliant style.

2. Description of the Prior Art

The most important style of cutting diamonds and other colorless or faintly colored stones is the brilliant cut. This cut consists of 57 facets, a table and 32 facets in the crown and 24 facets in the base or pavilion of the stone. As the name suggests, this type of cut provides a brilliant gem, whose multiple reflections provide clean, sharp flashes of light, commonly called "fire" by gemologists.

U.S. Pat. No. 3,585,764, issued June 22, 1971 to J. Huisman et al., discloses a method of promoting brilliance in a diamond which includes thickening and polishing the girdle.

A variation of the brilliant cut is the Spectabril cut, which consists of 85 facets, a table and 3 rows of 12 facets each in the crown, 3 rows of 12 facets each in the pavilion and 12 girdle facets. The Spectabril cut was described by R. F. Thompson in *Gems and Minerals*, May, 1973, p. 39.

An attractive gemstone is chrysoberyl, $BeAl_2O_4$ having the orthorhombic crystal structure. Many of these crystals exhibit pleochroism; that is, their color depends upon the viewing angle. Both natural and synthetic chrysoberyl have been cut in the brilliant style and variations thereof.

SUMMARY OF THE INVENTION

In accordance with the present invention, a brilliant single crystal chrysoberyl gemstone has an axis of symmetry, a crown, a girdle and a pavilion, in which (1) the crown comprises a table in the form of a first regular n-sided polygon whose plane is substantially perpendicular to the axis of symmetry; n substantially congruent triangular star facets, each facet having at least two substantially equal sides and a base coinciding with a side of the table; n substantially congruent triangular upper girdle facets, each facet having at least two substantially equal sides, a base coinciding with a side of a second regular n-sided polygon of the girdle and a common vertex with a star facet; and n substantially congruent kite-shaped main facets, each facet having one side coinciding with each of four surrounding triangular facets, one vertex coinciding with a vertex of the table facet and an opposite vertex coinciding with a vertex of said second regular n-sided polygon of the girdle;

(2) the girdle comprises n substantially congruent rectangular facets, each facet being in a plane substantially parallel to the axis of symmetry, the upper sides of the facets forming said second regular n-sided polygon and the lower sides of the facets forming a third regular n-sided polygon, the planes of said second and third regular n-sided polygons being substantially perpendicular to the axis of symmetry; and (3) the pavilion comprises n substantially congruent triangular lower girdle facets, each facet having at least two substantially equal sides and a base coinciding with a side of said third regular n-sided polygon of the girdle; n substantially congruent kite-shaped culet facets, each facet having a common vertex on the axis of symmetry and an opposite vertex coinciding with a vertex of a lower girdle facet and being substantially symmetrical about a line joining the common vertex and opposite vertex, the projection of said line on the plane of the table having length less than half the length of a line joining the centers of opposite sides of the table, whereby said culet facets present a rosette pattern when viewed through the table; and n substantially congruent kite-shaped pavilion main facets, each facet having an upper vertex coinciding with a vertex of the third regular n-sided polygon of the girdle and a lower vertex coinciding with a vertex of a culet facet and being substantially symmetrical about a line joining the upper and lower vertexes. In the description above, n is an even number between 7 and 13, preferably 12.

Among chrysoberyl crystals, alexandrite, which is a chrysoberyl containing chromium ion impurities, is particularly well suited for the practice of this invention. An alexandrite gemstone of the present invention, when viewed in natural light, displays a spectacular rosette pattern of vivid red with contrasting green, orange and/or blue. Neither the Spectabril nor other prior art brilliant or brilliant-like styles of cut display this pattern.

DETAILED DESCRIPTION OF THE INVENTION

Figure 1:
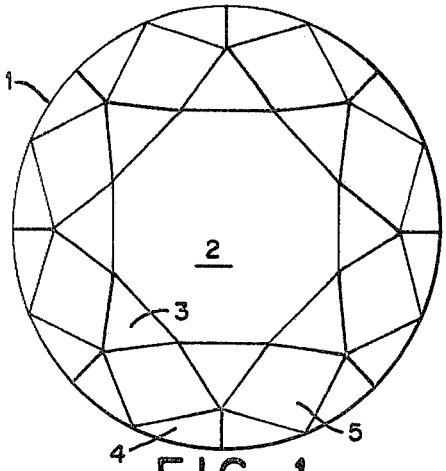
FIG. 1 is a top view of a standard brilliant gemstone of the prior art.

Chrysoberyl gemstones cut in the style of this invention provide a particularly attractive appearance. In a preferred embodiment of the invention, the gemstone is cut from a crystal of alexandrite, beryllium aluminate ($BeAl_2O_4$) containing chromium ion ($Cr^{3+}$) as an impurity. Alexandrite is one of the few trichroic minerals, that is it exhibits 3 distinct colors corresponding to the 3 possible polarization directions of light traveling through its orthorhombic crystal structure. The following lattice parameters have been assigned by Farrell, et al. in American Mineralogist 48, 804–810 (1963): $a=0.9404$ nm, $b=0.5476$ nm, $c=0.4427$ nm.

In preparing a gemstone of this invention from an alexandrite crystal, cuts need not be made in any particular orientation relative to the crystal axes. However, particularly striking gemstones result if the axis of symmetry lies along a crystal axis. An alexandrite gemstone shows predominantly purplish-blue, orange-red or green color if its axis of symmetry lies along the a, b or c axis of the crystal, respectively.

The present invention comprises gemstones having 8, 10, or 12 facets per row in 7 rows, including the girdle facets. The girdle facets are preferably less than about 1 mm high. Polishing the girdle facets provides greater brilliance and lighter color then would otherwise appear. As the number of facets per row increases, the gemstone appears darker; thus, the choice of the number of facets is guided by the darkness desired for the finished gemstone as well as by the depth of color of the crystal itself. Alexandrite containing about 0.05 to 1.0 atom percent trivalent chromium in place of aluminum provides material for particularly attractive gemstones, with concentrations in the range of about 0.1 to 0.5 atom percent preferred. In general, the coloring increases with increasing chromium ion concentration; thus, crystals with low chromium concentration require a larger number of facets per row to achieve a particular depth of color in a finished gemstone than do crystals with high chromium concentration.

In the most preferred embodiment of this invention, an alexandrite gemstone is cut with 12 facets per row. For this gemstone, the crown is cut so that the angle between the triangular star facets and the plane of the table is about 27° to 31°; the angle between the triangular upper girdle facets and the plane of the table is about 44° to 48°; and the angle between the kite-shaped main facets and the plane of the table is about 37° to 41°. The pavilion is cut so that the angle between the triangular lower girdle facets and the plane of the table is about 45° to 49°; the angle between the kite-shaped culet facets and the plane of the table is about 35° to 39°; and the angle between the kite-shaped pavilion main facets and the plane of the table is about 40° to 44°. Within the range of angles indicated, larger angles provide darker gemstones. Although these angles apply specifically to alexandrite gemstones, crystals having an index of refraction and specific gravity similar to alexandrite would be cut with similar angles. In general, the optimum angles are smaller for crystals having higher index of refraction and inversely.

Figure 2:
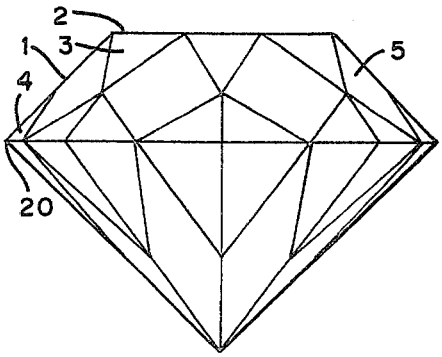
FIG. 2 is a side view of the stone shown in FIG. 1.
Figure 3:
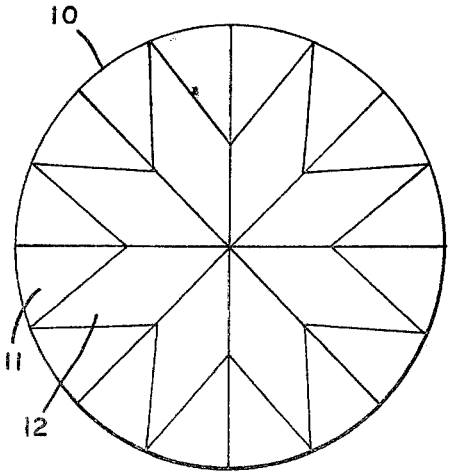
FIG. 3 is a bottom view of the stone shown in FIGS. 1 and 2.

Referring to the figures in more detail, we first note that the same reference numerals identify similar elements. FIGS. 1 to 3 show top, side and bottom views, respectively, of a prior art standard brilliant cut gemstone. The crown 1 comprises a table 2 in the shape of a regular octagon, 8 triangular star facets 3, 16 triangular upper girdle facets 4 and 8 kite-shaped main facets 5. The pavilion 10 comprises 16 triangular lower girdle facets 11 and 8 kite-shaped pavilion main facets 12. The crown and pavilion meet along the girdle 20.

Figure 4:
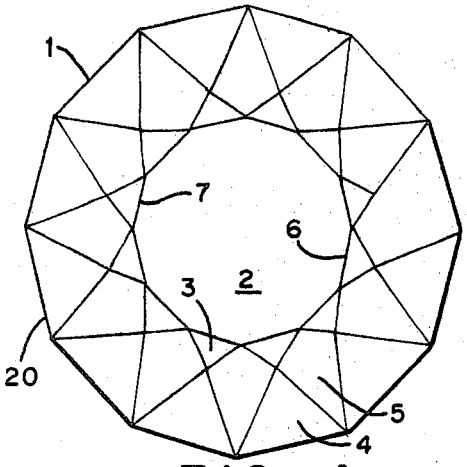
FIG. 4 is a top view of a Spectabril gemstone of the prior art.
Figure 5:
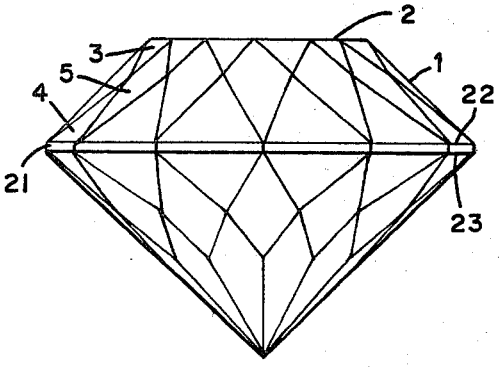
FIG. 5 is a side view of the stone shown in FIG. 4.
Figure 6:
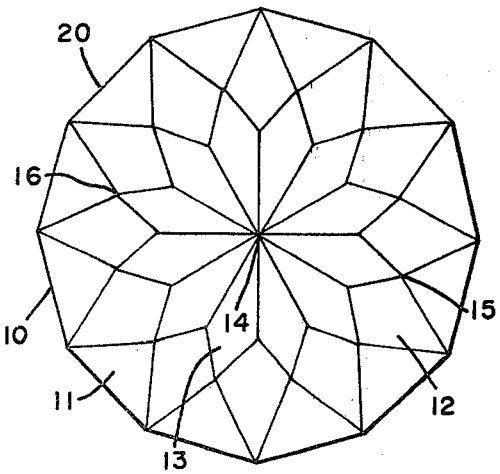
FIG. 6 is a bottom view of the stone shown in FIGS. 4 and 5.

FIGS. 4 to 6 show top, side and bottom views, respectively, of a prior art Spectabril gemstone. The crown 1 comprises a table 2 in the shape of a regular dodecagon, 12 triangular star facets 3, 12 triangular upper girdle facets 4, and 12 kite-shaped main facets 5. The centers of a pair of opposite sides of the table are designated 6 and 7. The pavilion 10 comprises 12 triangular lower girdle facets 11, 12 kite-shaped pavilion main facets 12 and 12 kite-shaped culet facets 13 having a common vertex 14. Opposite vertexes of a pair of culet facets whose projections on the plane of the table have a common axis of symmetry are designated 15 and 16. The girdle comprises a band of rectangular facets 21 formed by an upper regular dodecagon 22 adjoining the crown 1 and a lower regular dodecagon 23 adjoining the pavilion 10.

Figure 7:
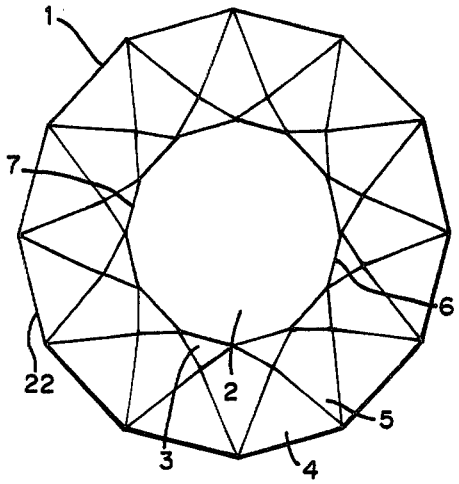
FIG. 7 is a top view of a gemstone of this invention.
Figure 8:
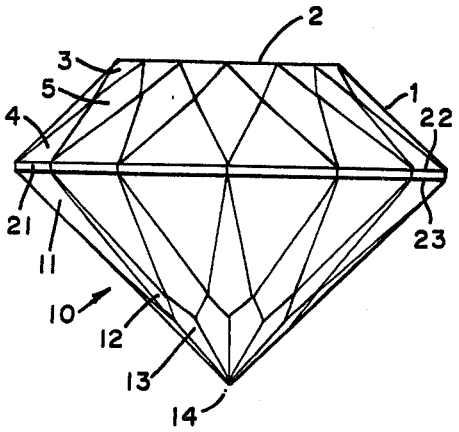
FIG. 8 is a side view of the stone shown in FIG. 7.
Figure 9:
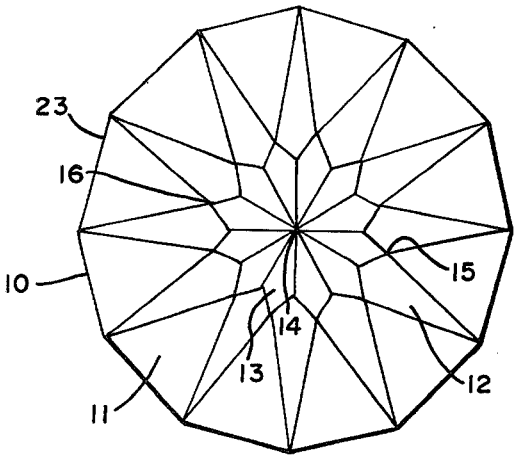
FIG. 9 is a bottom view of the stone shown in FIGS. 7 and 8.

FIGS. 7 to 9 show top, side and bottom views, respectively, of a gemstone of the present invention. The present gemstone differs from that of the prior art Spectabril gemstone as follows:

The culet facets 13 of the present invention are smaller than those of the prior art. Thus, the distance between points 15 and 16, opposite vertexes of culet facets whose projections on the plane of the table have a common axis of symmetry, is smaller than the distance between points 6 and 7, centers of opposite sides of the table. As a result, the culet facets present a rosette pattern when viewed through the table. In the prior art gemstone, the distance between points 15 and 16 is greater than that between 6 and 7; thus, no rosette pattern appears.

I claim:

1. A brilliant single crystal alexandrite gemstone having an axis of symmetry, a crown, a girdle and a pavilion, said crown comprising:

(a) a table in the form of a first regular n-sided polygon whose plane is substantially perpendicular to the axis of symmetry, (b) n substantially congruent triangular star facets, each facet having at least two substantially equal sides and a base coinciding with a side of the table;

(c) n substantially congruent triangular upper girdle facets, each facet having at least two substantially equal sides, a base coinciding with a side of a second regular n-sided polygon of the girdle and a common vertex with a star facet;

(d) n substantially congruent kite-shaped main facets, each facet having one side coinciding with each of four surrounding triangular facets, one vertex coinciding with a vertex of the table facet and an opposite vertex coinciding with a vertex of said second regular n-sided polygon of the girdle;

said girdle comprising:

(e) n substantially congruent rectangular facets, each facet being in a plane substantially parallel to the axis of symmetry, the upper sides of the facets forming said second regular n-sided polygon and the lower sides of the facets forming a third regular n-sided polygon, the planes of said second and third regular n-sided polygons being substantially perpendicular to the axis of symmetry;

and said pavillion comprising:

(f) n substantially congruent triangular lower girdle facets, each facet having at least two substantially equal sides and a base coinciding with a side of said third regular n-sided polygon of the girdle;

(g) n substantially congruent kite-shaped culet facets, each facet having a common vertex on the axis of symmetry and an opposite vertex coinciding with a vertex of a lower girdle facet and being substantially symmetrical about a line joining the common vertex and opposite vertex, the projection of said line on the plane of the table having length less than half the length of a line joining the centers of opposite sides of the table, whereby said culet facets present a rosette pattern when viewed through the table; and (h) n substantially congruent kite-shaped pavilion main facets, each facet having an upper vertex coinciding with a vertex of the third regular n-sided polygon of the girdle and a lower vertex coinciding with a vertex of a culet facet and being substantially symmetrical about a line joining the upper and lower vertexes, where n is an even number between 7 and 13.

2. The gemstone of claim 1 wherein n is 12.

3. The gemstone of claim 2 wherein:

(a) the angle between the triangular star facets and the plane of the table is about 27° to 31°, (b) the angle between the triangular upper girdle facets and the plane of the table is about 44° to 48°, (c) the angle between the kite-shaped main facets and the plane of the table is about 37° to 41°, (d) the angle between the triangular lower girdle facets and the plane of the table is about 45° to 49°, (e) the angle between the kite-shaped culet facets and the plane of the table is about 35° to 39°, and (f) the angle between the kite-shaped pavilion main facets and the plane of the table is about 40° to 44°.

4. The gemstone of claim 1 wherein the crystal is alexandrite which contains about 0.05 to 1.0 atom percent trivalent chromium in place of aluminum.

5. The gemstone of claim 4 wherein the alexandrite contains about 0.1 to 0.5 atom percent chromium.

6. The gemstone of claim 4 wherein the axis of symmetry is substantially along the a axis of the crystal.

7. The gemstone of claim 4 wherein the axis of symmetry is substantially along the b axis of the crystal.

8. The gemstone of claim 4 wherein the axis of symmetry is substantially along the c axis of the crystal.

9. The gemstone of claim 1 wherein the height of the girdle facets is less than about 1 mm.

* * * * *